US007334993B2

(12) United States Patent
Sekihara et al.

(10) Patent No.: US 7,334,993 B2
(45) Date of Patent: Feb. 26, 2008

(54) GAS TURBINE ROTOR BLADE, GAS TURBINE USING THE ROTOR BLADE, AND POWER PLANT USING THE GAS TURBINE

(75) Inventors: Masaru Sekihara, Arlington, VA (US); Yasushi Hayasaka, Mito (JP); Kunihiro Ichikawa, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/433,497

(22) Filed: May 15, 2006

(65) Prior Publication Data

US 2007/0065283 A1 Mar. 22, 2007

(30) Foreign Application Priority Data

May 16, 2005 (JP) ..... 2005-142199

(51) Int. Cl.
*F01D 5/18* (2006.01)
*F01D 5/26* (2006.01)

(52) U.S. Cl. ..... 416/97 R; 416/190

(58) Field of Classification Search ..... 415/173.1, 415/173.5, 173.6, 174.5; 416/92, 97 R, 191, 416/190

See application file for complete search history.

(56) References Cited

U.S. PATENT DOCUMENTS 6,152,695 A * 11/2000 Fukue et al. ..... 416/97 R
6,254,345 B1 * 7/2001 Harris et al. ..... 416/96 R
6,254,346 B1 * 7/2001 Fukuno et al. ..... 416/97 R
6,869,270 B2 * 3/2005 Bunker et al. ..... 416/97 R
6,932,577 B2 * 8/2005 Strohl et al. ..... 416/223 A

FOREIGN PATENT DOCUMENTS

JP 11-500507 1/1999
JP 2000-291405 10/2000

* cited by examiner

*Primary Examiner*—Ninh H. Nguyen
(74) *Attorney, Agent, or Firm*—Mattingly, Stanger, Malur & Brundidge, P.C.

(57) ABSTRACT

A gas turbine rotor blade capable of effectively reducing creep damage by forming a cooling through hole to cool a target area in which significant creep damage of a shroud cover is predicted based on analysis of stress and temperature acting on the gas turbine rotor blade. A gas turbine using the rotor blade, and a power plant using the gas turbine are also provided. The gas turbine rotor blade includes a blade section provided with a shroud cover at an outer peripheral end thereof, and a platform, a shank and a dovetail which are formed in integral structure to successively continue from the blade section. An inner cooling hole is formed to penetrate through the gas turbine rotor blade from the dovetail to the shroud cover. The shroud cover has a cooling through hole formed to open in an outer surface of the shroud cover and extend in communication with the inner cooling hole.

18 Claims, 9 Drawing Sheets

GAS TURBINE ROTOR BLADE, GAS TURBINE USING THE ROTOR BLADE, AND POWER PLANT USING THE GAS TURBINE

BACKGROUND OF THE INVENTION

1. Field of the Invention

The present invention relates to a novel gas turbine rotor blade which is used in a turbine for converting kinetic energy produced with expansion of a combustion gas to rotational motive power. The present invention also relates to a gas turbine using the rotor blade, and a power plant using the gas turbine.

2. Description of the Related Art

FIG. 12 is a sectional view showing a general structure of a gas turbine. The gas turbine mainly comprises a compressor 1, a combustor 2, and a turbine 3. The compressor 1 performs adiabatic compression by using, as a working fluid, air sucked from the atmosphere. In the combustor 2, fuel is mixed in the compressed air supplied from the compressor 1, and the mixture is burnt to produce a high-temperature and high-pressure gas. The turbine 3 generates rotational motive power when the combustion gas introduced from the combustor 2 is expanded. Exhaust from the turbine 3 is released to the atmosphere. Motive power left after subtracting the motive power required to drive the compressor 1 from the rotational motive power generated by the turbine 3 is obtained as effective motive power generated by the gas turbine, which is available to drive a generator.

As shown in FIG. 12, the turbine 3 comprises a turbine rotor blade 4, a turbine stator blade 5 for rectifying gas flows in an expansion process of the combustion gas, and a turbine rotor 6 having an outer periphery to which is fixed the turbine rotor blade 4.

FIGS. 13A and 13B are each a perspective view showing a shroud cover of the known turbine rotor blade. An outer surface of the turbine rotor blade 4 is heated to high temperature because the turbine rotor blade is used to convert kinetic energy produced with expansion of the combustion gas to rotational motive power. As shown in FIGS. 13A and 13B, a shroud cover 7 is provided to prevent the combustion gas from leaking toward the outer peripheral side and is fitted with the adjacent turbine rotor blades 4 to suppress vibrations.

Patent Document 1 (JP,A 2000-291405) discloses a shroud cover in which, for the purpose of cooling the whole of the shroud cover, a plenum is formed such that the interior of a blade section is also communicated with inner cooling holes through the plenum. A plurality of discharge holes are extended from the plenum and are opened at peripheries of the shroud cover. A possibility of creep rupture is reduced by cooling the shroud cover with such an arrangement.

Further, Patent Document 2 (JP,A 11-500507) discloses a shroud cover in which two shroud cooling air holes are formed to cool the shroud cover. This related art is also intended to reduce a possibility of creep rupture by cooling the shroud cover.

SUMMARY OF THE INVENTION

Recently, higher efficiency has been demanded in gas turbine facilities with the view of saving energy. As practical means for realizing the higher efficiency, there has been a trend to increase a compressor pressure ratio or to raise combustion temperature. Any of those means directly results in a rise of temperature acting on the turbine rotor blade. It is therefore predicted in future that the turbine rotor blade is exposed to environments under higher temperatures, and that higher strength and longer useful life are necessarily demanded.

Also, it has recently become an urgent necessity to cut the power generation cost under increasing social demands for a reduction of electrical charges. In particular, the repair cost of high-temperature components, such as the turbine rotor blade, takes a large proportion of the total repair cost of the entire gas turbine. From that point of view, cutting the routine inspection period and the number of necessary steps is demanded.

With Patent Document 1, however, there is a limitation in increasing the working efficiency because the plenum having a complicated structure has to be formed in the shroud cover. Further, since the shroud cover includes a plurality of cooling holes in which stresses tend to concentrate, it cannot be said that reliability of the turbine rotor blade is sufficient.

Of the turbine rotor blade 4, particularly the shroud cover 7 is exposed to severe environments in both points of temperature and load stress acting on it. As shown in FIG. 13B, in a root portion 8 of the shroud cover 7 in the form of a cantilevered beam, there is a possibility that a creep crack 9 is caused due to creep damage and affects the life of the turbine rotor blade 4. This implies the necessity of any countermeasure for coping with such a creep crack 9. Although the above-cited Patent Documents are both intended to reduce creep rupture by cooling the shroud cover, any of those Patent Documents takes no consideration of the creep damage that is possibly caused in the root portion 8 of the shroud cover 7 in the form of a cantilevered beam.

An object of the present invention is to provide a gas turbine rotor blade capable of effectively reducing creep damage by forming a cooling through hole to cool a target area in which significant creep damage of a shroud cover is predicted based on analysis of stress and temperature acting on the turbine rotor blade. Another object of the present invention is to provide a gas turbine using the rotor blade, and a power plant using the gas turbine.

The present invention is featured in analyzing stress and temperature acting on a turbine rotor blade, and forming a cooling through hole to extend from a blade surface in communication with an inner cooling hole in order to cool a target area in which significant creep damage is predicted based on the analysis result.

Another feature of the present invention resides in that, when an area for which creep damage has been determined insignificant at the time of design is subjected to a load different from that in design specification and is confirmed after operation for a certain period as being a new target area in which significant creep damage is predicted, a cooling through hole is also similarly formed to extend from the blade surface in communication with the inner cooling hole in order to cool such an area.

According to the present invention, it is possible to provide the gas turbine rotor blade capable of effectively reducing creep damage by forming the cooling through hole to cool the target area in which significant creep damage of the shroud cover is predicted based on analysis of stress and temperature acting on the turbine rotor blade. A gas turbine using the rotor blade and a power plant using the gas turbine can also be provided.

REFERENCE NUMERALS

1 . . . compressor, 2 . . . combustor, 3 . . . turbine, 4 . . . turbine rotor blade, 5 . . . turbine stator blade, 6 . . . turbine rotor, 7 . . . shroud cover, 8 . . . shroud cover root portion, 9 . . . creep crack, 10 . . . target area in which significant creep damage is predicted, 11 . . . inner cooling hole, 12 . . . cooling through hole, 13 . . . peripheral area surrounding the target area in which significant creep damage is predicted, 14 . . . sealing edge, 15 . . . heat-shield coating, 16 . . . position where cooling hole is formed, 17 . . . bending stress neutral axis, 18 . . . replacement part for shroud cover, 20 . . . blade portion, 21 . . . platform, 22 . . . shank, and 23 . . . dovetail.

DESCRIPTION OF THE PREFERRED EMBODIMENTS

The best mode for carrying out the present invention will be described below in connection with embodiments.

First Embodiment

Figure 1:
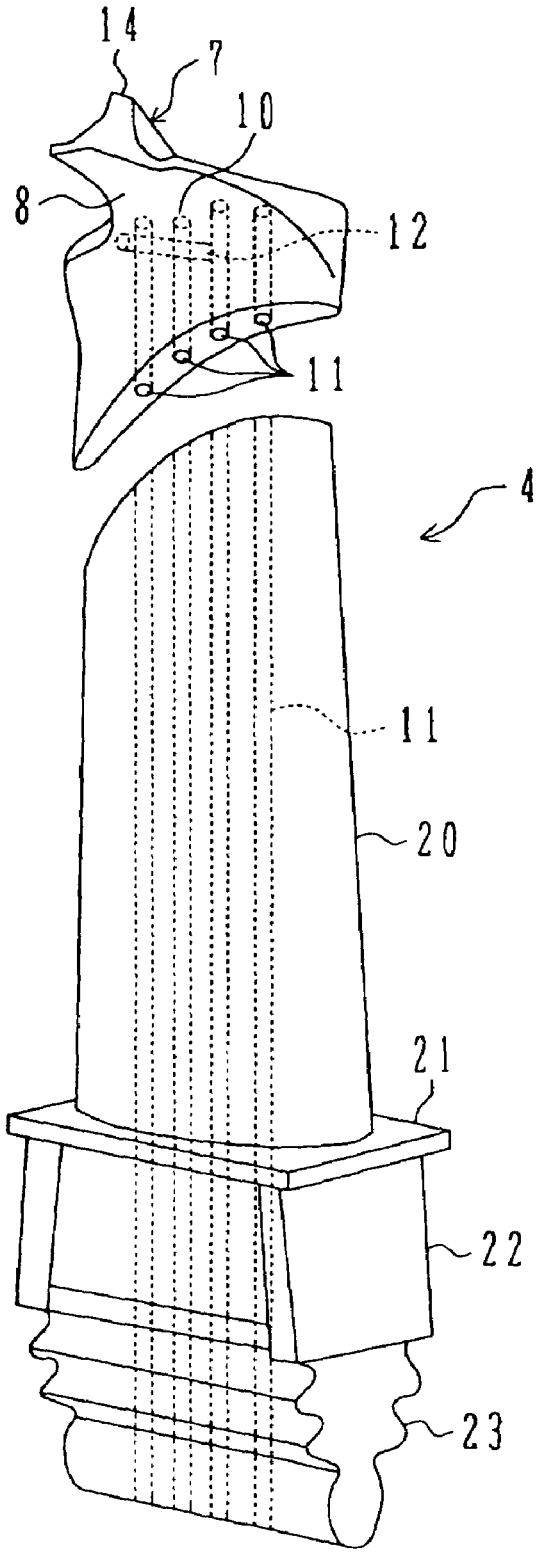
FIG. 1 is a perspective view of a gas turbine rotor blade and a shroud cover according to a first embodiment of the present invention.

FIG. 1 is a perspective view of a gas turbine rotor blade and a shroud cover according to a first embodiment of the present invention. A (gas) turbine rotor blade 4 according to the present invention includes a blade section 20 provided with a shroud cover 7 at its outer peripheral end, and a platform 21, a shank 22 and a dovetail 23 which are formed in integral structure to successively continue from the blade section 20. A plurality of inner cooling holes 11 for air cooling are formed in the turbine rotor blade 4 to straightly penetrate through the entire blade from the dovetail 23 to the shroud cover 7 where the holes 11 are opened. Although the shroud cover 7 and the blade section 20 are shown as being separated from each other, they form in fact an integral structure. The turbine rotor blade 4 according to this first embodiment has a plurality of cooling through holes 12 (described later) each having a diameter of about 2-5 mm, and is used in each of second and third stages of a gas turbine. Further, the turbine rotor blade 4 may be any of an equiaxial product, a unidirectional solidification product, and a single crystal product made of a Ni-base alloy and integrally formed by precision molding in its entirety.

The shroud cover 7 includes a ridge-like sealing edge 14 formed along the outer peripheral side to extend over its entire length in the rotating direction, to thereby prevent leakage of a combustion gas, and a flat plate portion fitted with the adjacent turbine rotor blades 4 to suppress vibrations thereof. A plurality of shroud covers 7 are formed in mutually joined manner over the entire circumference. Correspondingly, a plurality of sealing edges 14 are joined with each other in the longitudinal direction over the entire circumference into the form of one ring. The flat plate portion has such a similar planar shape on both the concave and convex sides of the blade section 20 that it is recessed from the end of the sealing edge 14 and is expanded toward the leading and trailing sides.

In this first embodiment, one cooling through hole 12 having a straight shape is provided to cool the vicinity of a root portion 8 of the shroud cover 7, i.e., a target area 10 in which significant creep damage is predicted. More specifically, the cooling through hole 12 is located in the shroud cover root portion 8 on the backside opposite to the belly side that receives the combustion gas, and is straightly formed with one end opened to an outer surface at a position laterally away from the target area 10 and the other end connected to one of the inner cooling holes 11. Air introduced from the inner cooling hole 11 is discharged to the outside after having passed the cooling through hole 12. The cooling through hole 12 is preferably formed in a region ranging from the shroud cover root portion 8 as an upper limit to a point corresponding to 75% of the overall length of the turbine rotor blade 4 as a lower limit.

Figure 2:
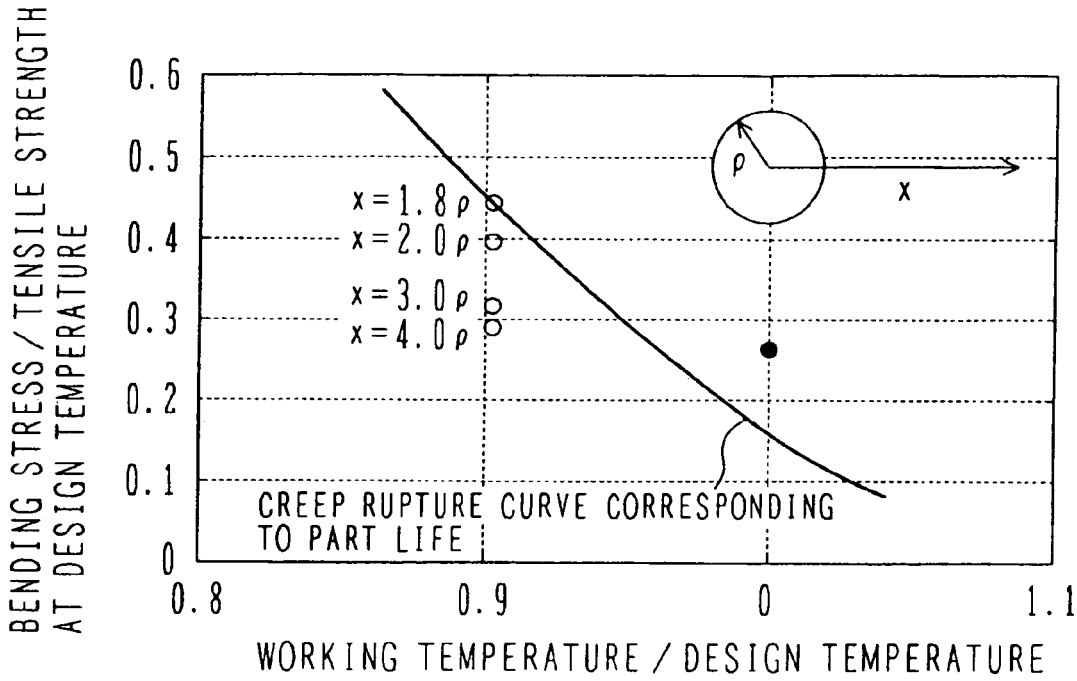
FIG. 2 is a graph showing the relationship between allowable stress for creep damage and temperature.

FIG. 2 is a graph showing the relationship between allowable stress (bending stress/tensile strength at design temperature) for creep damage and a ratio of (working temperature/design temperature). In the graph, $\rho$ represents the radius of the cooling through hole, and x represents the distance from the hole center. Generally, as plotted in FIG. 2, a value of the creep rupture strength corresponding to the part life is steeply increased with a decrease of temperature. Also, if the distance from the center of the cooling through hole exceeds 1.8 times the radius of the hole, a rate of increase of working stress due to stress concentration may be smaller than a rate of increase of the allowable stress. For that reason, in this first embodiment, the cooling through hole 12 is preferably formed to extend from the surface of the blade section 20 to the inner cooling hole 11 inside the blade section in the region ranging from the shroud cover root portion 8 as an upper limit to the point corresponding to 75% of the overall length of the turbine rotor blade 4 as a lower limit.

Further, the stress and temperature acting on the turbine rotor blade 4 are analyzed in advance. Based on the analysis result, in order to cool the target area 10 in which significant creep damage is predicted, the cooling through hole 12 is formed to extend, until one of the inner cooling holes 11, from the surface of the blade section 20 at a position away from the target area 10 to such an extent that the influence of stress concentration upon the target area 10 is sufficiently reduced. The cooling effect is thereby effectively enhanced. Thus, an opening of the cooling through hole 12 is positioned away from the target area 10. The cooling through hole 12 can be formed by any of drilling, electrical discharge machining, and laser machining.

Figure 3A:
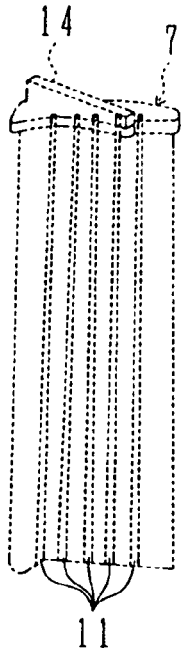
FIGS. 3A and 3B are illustrations showing X-ray images for examining positions of inner cooling holes in a rotor blade.
Figure 3B:
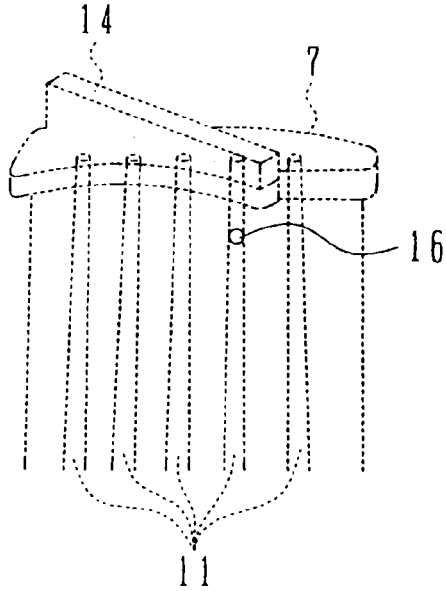

FIGS. 3A and 3B are illustrations showing X-ray images for examining positions of the inner cooling holes in the turbine rotor blade. Preferably, as shown in FIGS. 3A and 3B, the positions of the inner cooling holes 11 in the turbine rotor blade 4 are examined by taking X-ray images, and after confirming the positions of the inner cooling holes 11, a position 16 of the cooling through hole 12 is instructed. Then, the cooling through hole 12 is formed in the position 16.

Moreover, when an area for which creep damage has been determined insignificant at the time of design is confirmed after operation for a certain period as being a new target area 10 in which significant creep damage is predicted, the cooling through hole 12 can be similarly formed to cool such an area.

According to the first embodiment, as described above, creep damage of the turbine rotor blade can be effectively reduced just by forming the cooling through hole, which has a straight shape and is easiest to machine, in the target area in which significant creep damage of the shroud cover is predicted based on the analysis of the stress and temperature acting on the gas turbine rotor blade.

Second Embodiment

Figure 4:
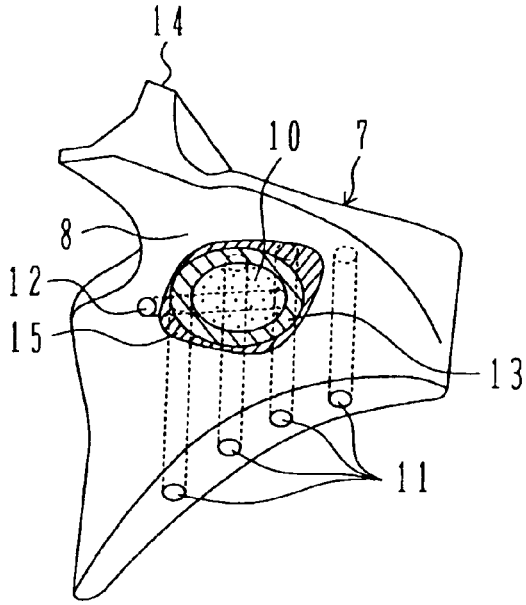
FIG. 4 is a perspective view of a shroud cover of a gas turbine rotor blade according to a second embodiment of the present invention.

FIG. 4 is a perspective view of a shroud cover of a gas turbine rotor blade according to a second embodiment of the present invention. As shown in FIG. 4, the cooling through hole 12 is formed to extend from the surface of the blade section 20 in communication with the inner cooling hole 11 in the region ranging from the shroud cover root portion 8 as an upper limit to the point away from the dovetail 23 by a distance corresponding to 75% of the overall length of the turbine rotor blade 4 as a lower limit. As in the first embodiment, the cooling through hole 12 is opened at a position laterally of the target area 10. The turbine rotor blade 4 in this second embodiment also has the same overall structure as that in the first embodiment.

The stress and temperature acting on the turbine rotor blade 4 are analyzed in advance. Based on the analysis result, as in the first embodiment, the cooling through hole 12 is formed to extend, until one of the inner cooling holes 11, from the surface of the blade section 20 at a position away from the target area 10 to such an extent that the influence of stress concentration upon the target area 10 in which significant creep damage of the shroud cover is predicted is sufficiently reduced. In addition, a heat-shield coating 15 is formed so as to cover an entire surface of the target area 10 in which significant creep damage is predicted, to thereby further enhance the cooling effect. The cooling through hole 12 can be formed in the same manner as in the first embodiment. Also in this second embodiment, the cooling through hole 12 is provided on the backside of the turbine rotor blade 4 in the target area 10 in which significant creep damage is predicted, and the heat-shield coating 15 is also formed on the backside of the turbine rotor blade 4. The target area 10 is located in a curved zone of the shroud cover root portion 8 and corresponds to a half of its central region in the direction of width thereof.

The heat-shield coating 15 is provided so as to cover not only the target area 10 in which significant creep damage is predicted, but also a peripheral area 13 surrounding the target area 10. In practice, the heat-shield coating 15 is preferably formed through the steps of forming, as an undercoat, a Ni-base alloy, e.g., NiCrAlY, by plasma spraying, and forming ceramic powder, e.g., $ZrO_2$, containing a stabilizing material, e.g., $Y_2O_3$, on the undercoat. Moreover, when an area for which creep damage has been determined insignificant at the time of design is confirmed after operation for a certain period as being a new target area 10 in which significant creep damage is predicted, the cooling through hole 12 and the heat-shield coating 15 can be similarly formed for the new target area 10 in which significant creep damage is predicted. As a result, such an area can also be cooled with the enhanced cooling effect and similar advantages to those in the first embodiment can be obtained.

Third Embodiment

Figure 5A:
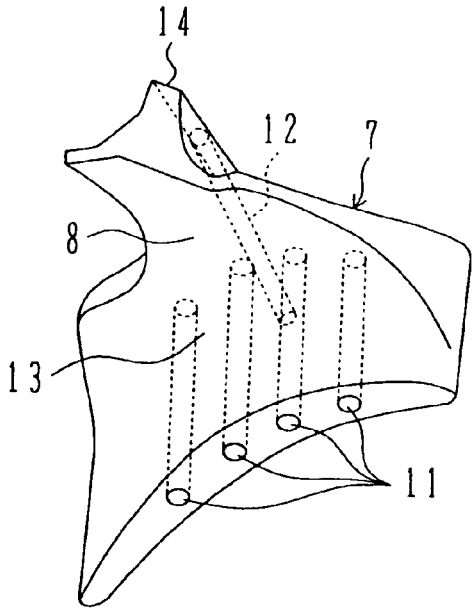
FIGS. 5A and 5B are each a perspective view of a shroud cover of a gas turbine rotor blade according to a third embodiment of the present invention.
Figure 5B:
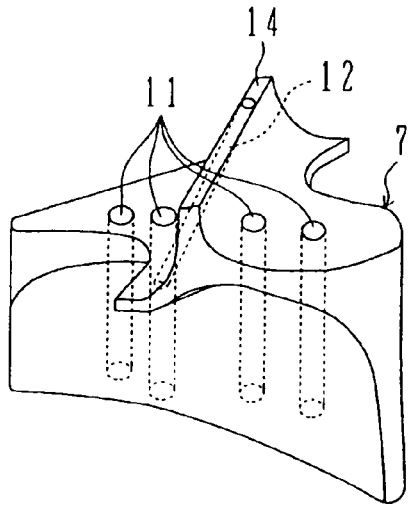

FIGS. 5A and 5B are each a perspective view of a shroud cover of a gas turbine rotor blade according to a third embodiment of the present invention. In the above first embodiment, because the cooling through hole 12 is formed in orthogonal relation to centrifugal stress, the allowable stress shown in FIG. 2 may be exceeded due to stress concentration depending on the stress before the machining and the hole shape. To cope with such a case, in this third embodiment, the stress and temperature acting on the turbine rotor blade 4 are analyzed in advance. Based on the analysis result, the cooling through hole 12 is formed to be opened in a longitudinal top surface of the sealing edge 14 and to extend until one of the inner cooling holes 11, while passing a point within 20 mm from the surface of the blade section 20 in the target area 10 in which significant creep damage is predicted. The cooling through hole 12 is provided on the backside of the turbine rotor blade 4 as in the first embodiment and can be formed in a similar manner. Incidentally, the inner cooling holes 11 are all formed to penetrate through the turbine rotor blade 4 and opened in the flat plate portions of the shroud cover 7 other than the sealing edge 14. This third embodiment can also provide similar advantages to those in the first embodiment.

Moreover, when an area for which creep damage has been determined insignificant at the time of design is confirmed after operation for a certain period as being a new target area 10 in which significant creep damage is predicted, the cooling through hole 12 can be similarly formed to cool such an area.

Fourth Embodiment

Figure 6A:
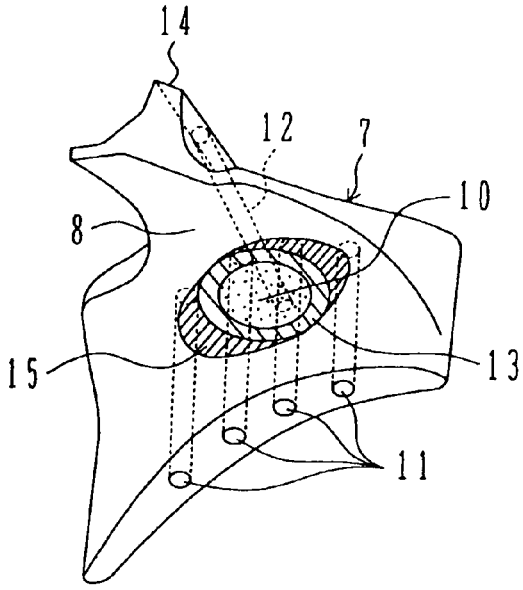
FIGS. 6A and 6B are each a perspective view of a shroud cover of a gas turbine rotor blade according to a fourth embodiment of the present invention.
Figure 6B:
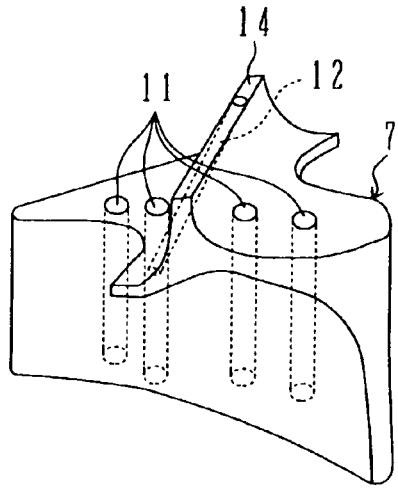

FIGS. 6A and 6B are each a perspective view of a shroud cover of a gas turbine rotor blade according to a fourth embodiment of the present invention. Also in this fourth embodiment, as in the case of FIG. 5, the cooling through hole 12 is formed to extend from the sealing edge 14 until one of the inner cooling holes 11, while passing a point within 20 mm from the surface of the blade section 20 in the target area 10 in which significant creep damage is predicted. The cooling through hole 12 is provided on the backside of the turbine rotor blade 4 as in the first embodiment and can be formed in a similar manner. In addition, as in the second embodiment, the heat-shield coating 15 is formed so as to cover the whole of the target area 10 in which significant creep damage is predicted, to thereby further enhance the cooling effect.

Moreover, when an area for which creep damage has been determined insignificant at the time of design is confirmed after operation for a certain period as being a new target area 10 in which significant creep damage is predicted, the cooling through hole 12 and the heat-shield coating 15 can be similarly formed for the new target area 10 in which significant creep damage is predicted, in order to cool such an area with the enhanced cooling effect.

Fifth Embodiment

Figure 7:
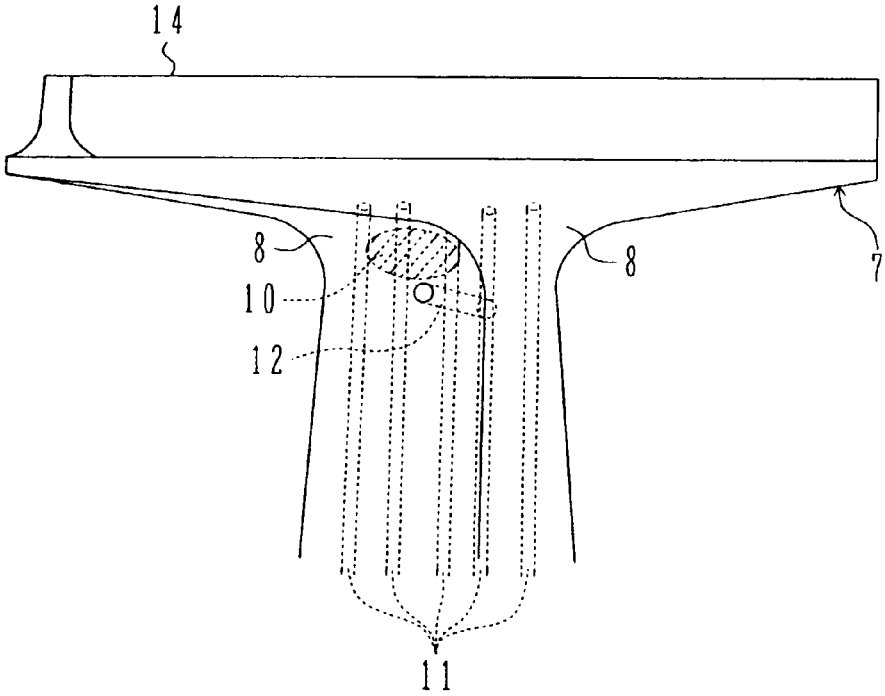
FIG. 7 is a perspective view of a shroud cover of a gas turbine rotor blade according to a fifth embodiment of the present invention.

FIG. 7 is a perspective view of a shroud cover of a gas turbine rotor blade according to a fifth embodiment of the present invention. In this fifth embodiment, the stress and temperature acting on the turbine rotor blade 4 are analyzed in advance. Based on the analysis result, as shown in FIG. 7, one cooling through hole 12 is formed to be opened at a position below the curved zone of the shroud cover root portion 8 where stresses are concentrated, and to extend from that position until one of the inner cooling holes 11, in order to cool the target area 10 in which significant creep damage is predicted. The cooling through hole 12 can be formed in a similar manner to that in the first embodiment. This fifth embodiment can also provide similar advantages to those in the first embodiment.

Moreover, when an area for which creep damage has been determined insignificant at the time of design is confirmed after operation for a certain period as being the target area 10 in which significant creep damage is predicted, the cooling through hole 12 can be similarly formed to cool such an area.

Sixth Embodiment

Figure 8:
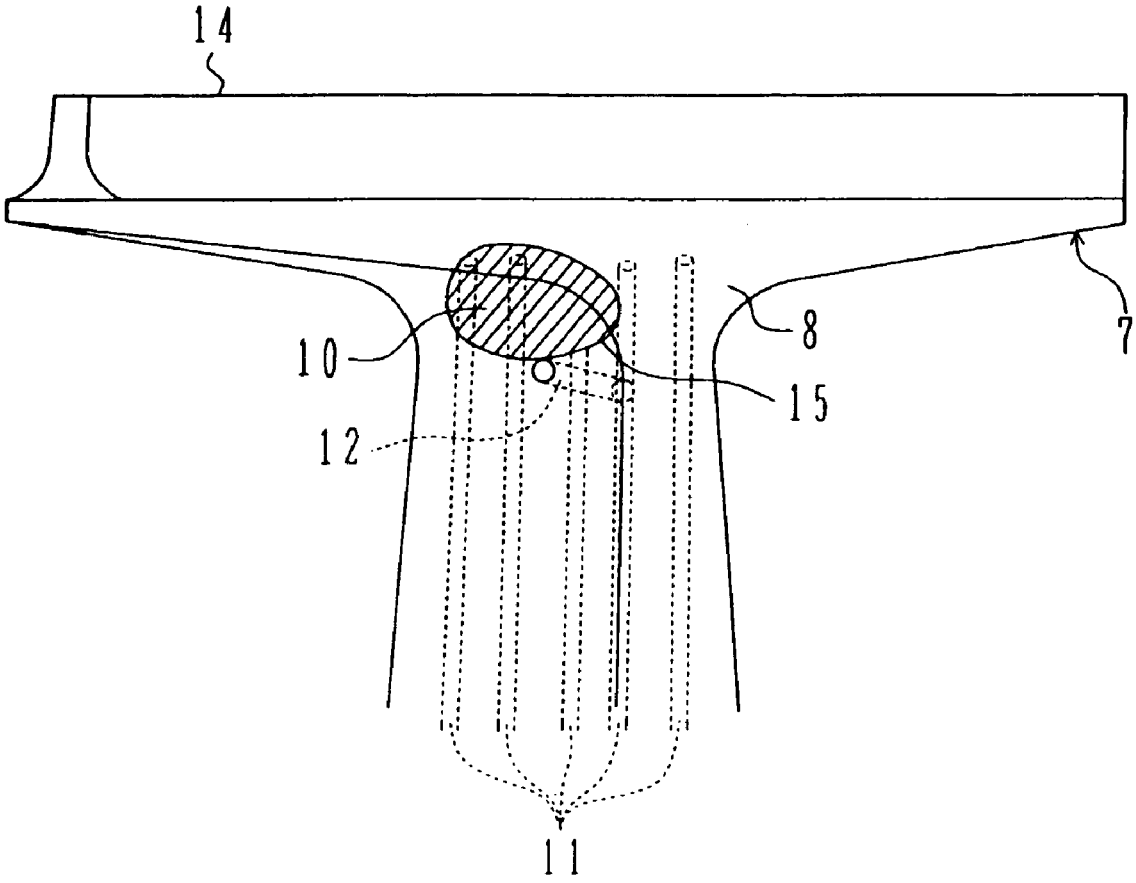
FIG. 8 is a perspective view of a shroud cover of a gas turbine rotor blade according to a sixth embodiment of the present invention.

FIG. 8 is a perspective view of a shroud cover of a gas turbine rotor blade according to a sixth embodiment of the present invention. In this sixth embodiment, as shown in FIG. 8, the cooling through hole 12 is formed to extend from the surface of the blade section 20 to one of the inner cooling holes 11 inside the blade section 20, while bypassing the curved zone of the shroud cover root portion 8, in the region ranging from the shroud cover root portion 8 as an upper limit to the point away from the dovetail 23 by a distance corresponding to 75% of the overall length of the turbine rotor blade 4 as a lower limit.

The stress and temperature acting on the turbine rotor blade 4 are analyzed in advance. Based on the analysis result, one cooling through hole 12 is formed to be opened at a position below the curved zone of the shroud cover root portion 8 where stresses are concentrated, and to extend from that position until one of the inner cooling holes 11, in order to cool the target area 10 in which significant creep damage is predicted. In addition, as in the second and fourth embodiments, the heat-shield coating 15 is formed so as to cover the whole of the target area 10 in which significant creep damage is predicted, to thereby further enhance the cooling effect. The cooling through hole 12 can be formed in a similar manner to that in the first embodiment. This sixth embodiment can also provide similar advantages to those in the first embodiment.

Moreover, when an area for which creep damage has been determined insignificant at the time of design is confirmed after operation for a certain period as being a new target area 10 in which significant creep damage is predicted, the cooling through hole 12 and the heat-shield coating 15 can be similarly formed for the new target area 10 in which significant creep damage is predicted, in order to cool such an area with the enhanced cooling effect.

Seventh Embodiment

Figure 9A:
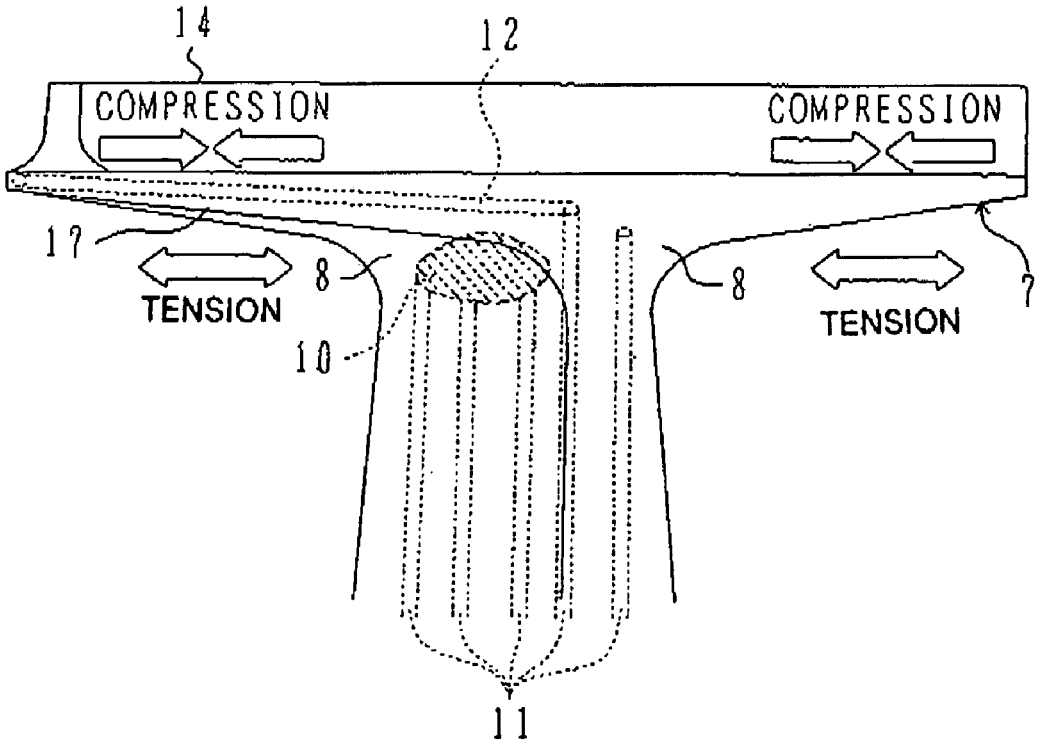
FIGS. 9A and 9B are each a perspective view of a shroud cover of a gas turbine rotor blade according to a seventh embodiment of the present invention.
Figure 9B:
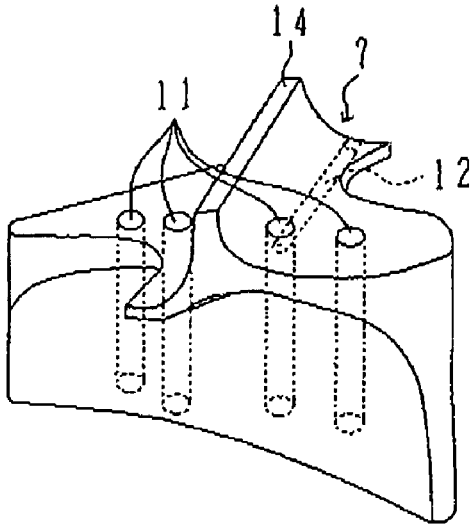

FIGS. 9A and 9B are each a perspective view of a shroud cover of a gas turbine rotor blade according to a seventh embodiment of the present invention. In this seventh embodiment, the stress and temperature acting on the turbine rotor blade 4 are analyzed in advance. Based on the analysis result, as shown in FIGS. 9A and 9B, the cooling through hole 12 is formed to penetrate through the flat plate portion of the shroud cover 7, in which there occur tensile bending stress in a lower surface of the flat plate portion and compressive bending stress in an upper surface thereof, along a stress neutral axis 17 on either side of the sealing edge 14 in order to cool the target area 10 in which significant creep damage is predicted.

Further, as shown in FIG. 9B, the cooling through hole 12 is opened in a lateral surface of the flat plate portion continuously extended from an end surface of the sealing edge 14. The cooling through hole 12 can be formed in a similar manner to that in the first embodiment. This seventh embodiment can also provide similar advantages to those in the first embodiment.

Moreover, when an area for which creep damage has been determined insignificant at the time of design is confirmed after operation for a certain period as being the target area 10 in which significant creep damage is predicted, the cooling through hole 12 can be similarly formed to cool such an area.

Eighth Embodiment

Figure 10:
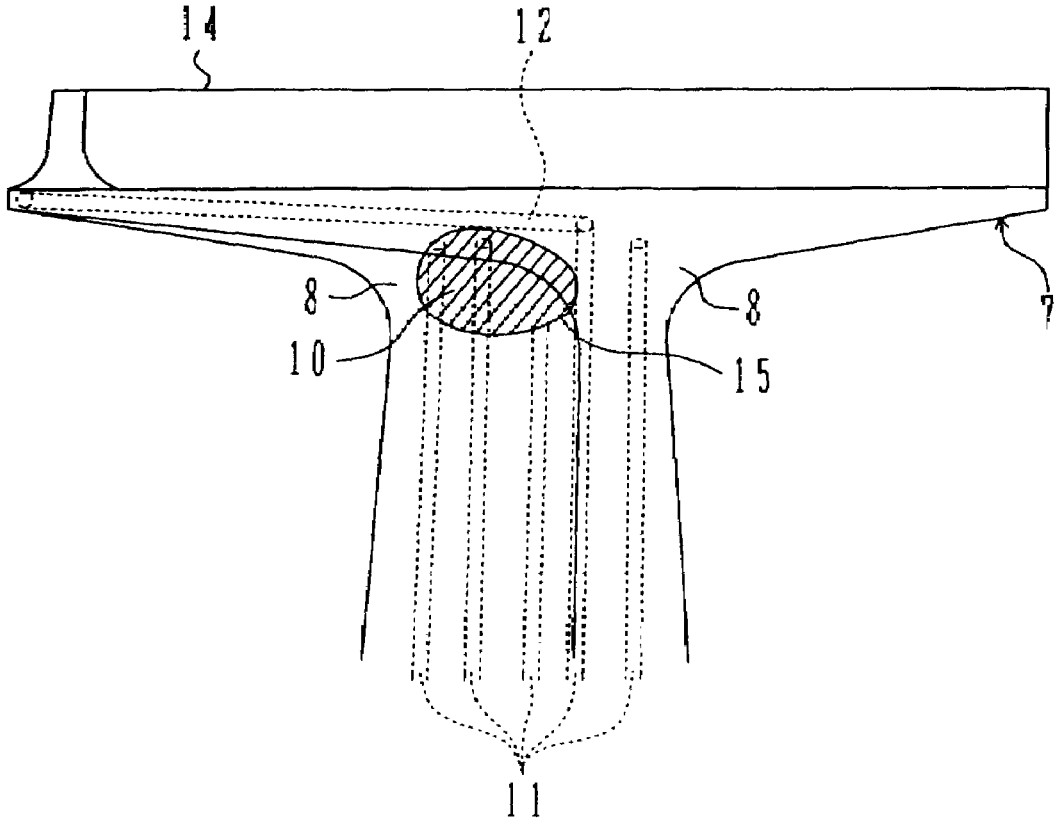
FIG. 10 is a perspective view of a shroud cover of a gas turbine rotor blade according to an eighth embodiment of the present invention.

FIG. 10 is a perspective view of a shroud cover of a gas turbine rotor blade according to an eighth embodiment of the present invention. In this eighth embodiment, the cooling through hole 12 is formed in the same manner as in the case of FIGS. 9A and 9B. More specifically, the stress and temperature acting on the turbine rotor blade 4 are analyzed in advance. Based on the analysis result, the cooling through hole 12 is formed to penetrate through the flat plate portion of the shroud cover 7, in which there occur tensile bending stress in its lower surface and compressive bending stress in its upper surface, along the stress neutral axis 17 in order to cool the target area 10 in which significant creep damage is predicted. In addition, the heat-shield coating 15 is formed so as to cover the whole of the target area 10 in which significant creep damage is predicted, to thereby further enhance the cooling effect. The cooling through hole 12 can be formed in a similar manner to that in the first embodiment. This eighth embodiment can also provide similar advantages to those in the first embodiment.

Moreover, when an area for which creep damage has been determined insignificant at the time of design is confirmed after operation for a certain period as being a new target area 10 in which significant creep damage is predicted, the cooling through hole 12 and the heat-shield coating 15 can be similarly formed for the new target area 10 to cool it.

Ninth Embodiment

Figure 11A:
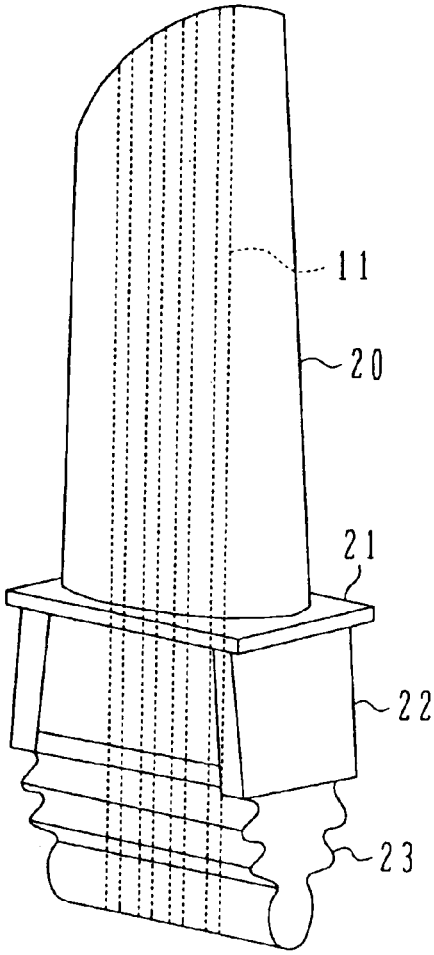
FIGS. 11A-11D is a perspective view of a shroud cover of a gas turbine rotor blade according to a ninth embodiment of the present invention.
Figure 11B:
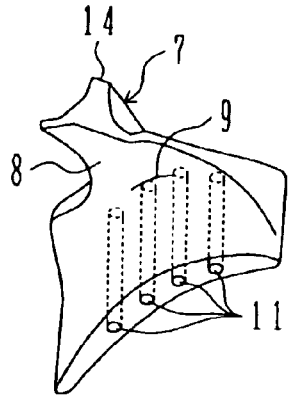
Figure 11C:
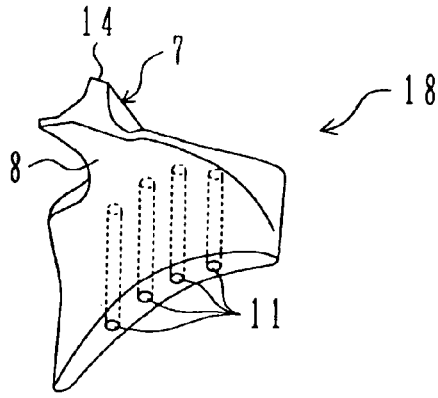
Figure 11D:
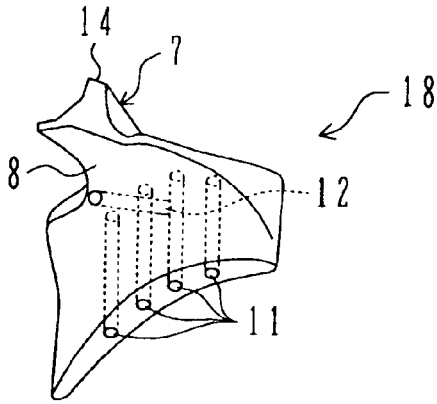

FIGS. 11A-11D are each a perspective view of a gas turbine rotor blade and a shroud cover according to a ninth embodiment of the present invention. In this ninth embodiment, as shown in FIGS. 11C and 11D, replacement parts 18 for the shroud cover 7 are prepared in advance. When a creep crack 9 is found in the shroud cover 7 as shown in FIG. 11B, that portion is cut and the replacement part 18 is joined instead of the cut portion by electron beam welding or liquid-phase diffusion bonding while a Ni-base alloy foil containing B is interposed between the joined parts.

Practically, the cut portion can be repaired by joining the replacement part 18 provided with the cooling through hole 12, as shown in FIG. 11D, or joining the replacement part 18 provided with no cooling through hole 12, as shown in FIG. 11C, and then forming the cooling through hole 12, in order to enhance the cooling effect. In addition, as in the above-described embodiments, the heat-shield coating 15 can also be formed by plasma spraying so as to cover the whole of the target area 10 in which significant creep damage is predicted, to thereby further enhance the cooling effect. In the replacement part 18, the cooling through hole 12 can be formed in any of the arrangements described above in connection with the first to sixth embodiments.

Tenth Embodiment

Figure 12:
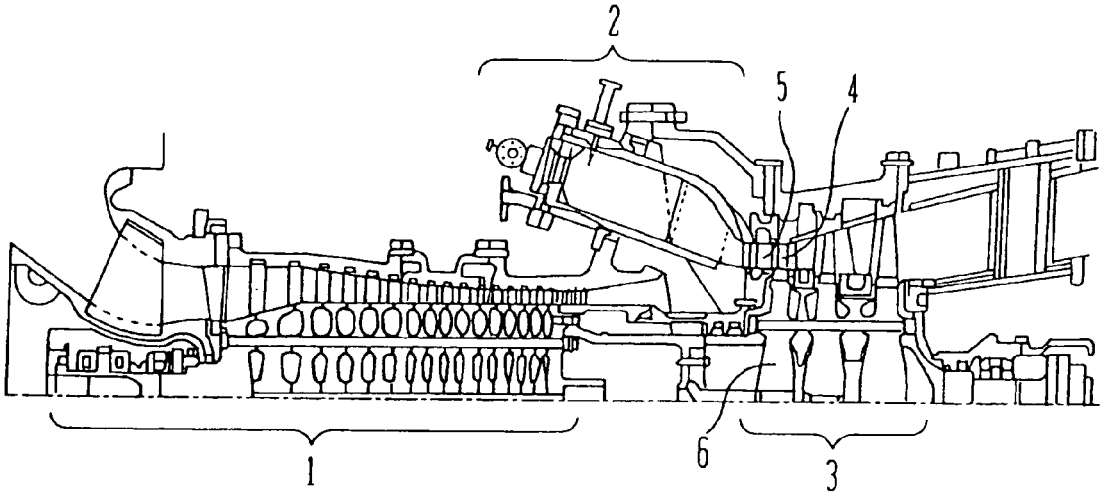
FIG. 12 is a sectional view showing a general structure of a gas turbine.
Figure 13A:
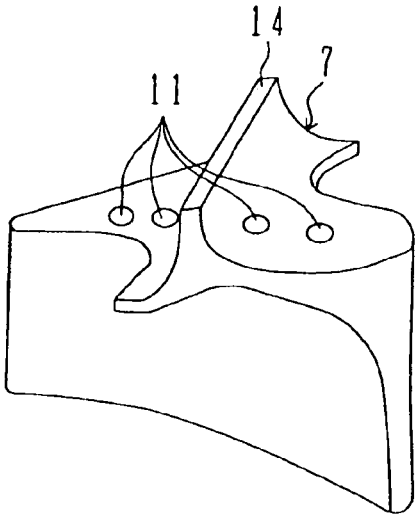
FIGS. 13A and 13B are each a perspective view of a shroud cover of a known gas turbine rotor blade.
Figure 13B:
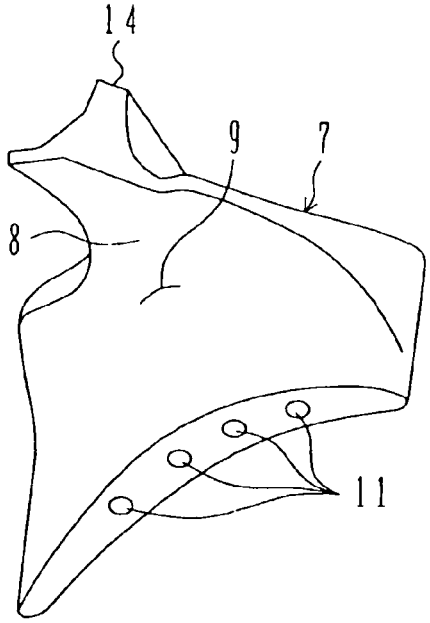

In this tenth embodiment, the turbine rotor blade provided with the cooling through hole, according to any one of the first to ninth embodiments, is employed as turbine rotor blades in second and third stages of the gas turbine shown in FIG. 12. The gas turbine can be connected to a generator for generation of electric power.

According to this tenth embodiment, since creep damage of the turbine rotor blade can be effectively reduced by forming the cooling through hole to cool the target area of the shroud cover in which significant creep damage is predicted based on analysis of the stress and temperature acting on the turbine rotor blade, the useful life of the turbine rotor blade can be greatly prolonged. It is hence possible to prolong the useful life of the gas turbine itself, and to ensure stably supply of electric power from a power plant.

What is claimed is:

1. A gas turbine rotor blade including a blade section provided with a shroud cover at an outer peripheral end thereof, and a platform, a shank and a dovetail which are formed in an integral structure to successively continue from said blade section, said gas turbine rotor blade having an inner cooling hole formed to penetrate through said gas turbine rotor blade from said dovetail to said shroud cover, wherein said shroud cover has a cooling through hole formed to open in an outer surface of said shroud cover and extend in communication with said inner cooling hole for cooling a target area in which significant creep damage of the shroud cover is predicted, in the vicinity of a root portion of the shroud cover projecting, in the form of a cantilevered beam, said cooling through hole being formed to open at a position away from said target area, with the distance from the center of the cooling through hole from said target area exceeding 1.8 times the radius of said cooling through hole.

2. The gas turbine rotor blade according to claim 1, wherein said shroud cover has a flat surface on the outer peripheral side thereof to prevent leakage of a combustion gas and to suppress vibrations by being fitted with adjacent gas turbine rotor blades.

3. The gas turbine rotor blade according to claim 2, wherein said shroud cover has a ridge-like sealing edge formed along an outer peripheral surface thereof to extend in a direction of rotation of said shroud cover.

4. The gas turbine rotor blade according to claim 2, wherein said cooling through hole is formed to be opened in a root portion of said shroud cover on the backside of said blade section with respect to the direction of rotation.

5. The gas turbine rotor blade according to claim 1, wherein said shroud cover has a ridge-like sealing edge formed along an outer peripheral surface thereof to extend in a direction of rotation of said shroud cover.

6. The gas turbine rotor blade according to claim 5, wherein said cooling through hole is formed to be opened in a root portion of said shroud cover on the backside of said blade section with respect to the direction of rotation.

7. The gas turbine rotor blade according to claim 1, wherein said cooling through hole is formed to be opened in a root portion of said shroud cover on the backside of said blade section with respect to the direction of rotation.

8. The gas turbine rotor blade according to claim 1, wherein said cooling through hole is formed in a region closer to said shroud cover than a point spaced from said dovetail by a distance corresponding to 75% of an overall length of said gas turbine rotor blade.

9. The gas turbine rotor blade according to claim 1, wherein said target area is one in which occurrence of a creep crack is predicted from an analysis based on working temperature and bending stress of on said shroud cover.

10. The gas turbine rotor blade according to claim 1, wherein said cooling through hole is formed by one of electrical discharge machining, laser machining, and drilling.

11. The gas turbine rotor blade according to claim 1, wherein a heat-shield coating is formed over a surface of the target area.

12. The gas turbine rotor blade according to claim 1, wherein a position of said inner cooling hole is examined by taking an X-ray image of said inner cooling hole before said cooling through hole is formed.

13. A gas turbine comprising a compressor for compressing air sucked as a working fluid from the atmosphere, a combustor for mixing fuel in the compressed air and burning a mixture to produce a high-temperature and high-pressure combustion gas, and a turbine for generating rotational motive power by a gas turbine rotor blade when the combustion gas is expanded, wherein said gas turbine rotor blade is the gas turbine rotor blades according to claim 1.

14. A gas turbine power plant including a generator for generating electric power with the rotational motive power generated by the gas turbine according to claim 13.

15. A gas turbine rotor blade including a blade section provided with a shroud cover at an outer peripheral end thereof, and a platform, a shank and a dovetail which are formed in an integral structure to successively continue from said blade section, said gas turbine rotor blade having an inner cooling hole formed to penetrate through said gas turbine rotor blade from said dovetail to said shroud cover, wherein said shroud cover has a cooling through hole formed to open in an outer surface of said shroud cover and extend in communication with said inner cooling hole for cooling a target area in which significant creep damage of the shroud cover is predicted, in the vicinity of a root portion of the shroud cover projecting in the form of a cantilevered beam, said shroud cover having a ridge-like sealing edge formed along an outer peripheral surface thereof to extend in a direction of rotation of said shroud cover, said cooling through hole being formed to open in an outer periphery of said ridge-like sealing edge, and said cooling through hole being formed to pass through within 20 mm from the surface of said target area.

16. The gas turbine rotor blade according to claim 15, wherein a heat-shield coating is formed over a surface of the target area.

17. A gas turbine comprising a compressor for compressing air sucked as a working fluid from the atmosphere, a combustor for mixing fuel in the compressed air and burning a mixture to produce a high-temperature and high-pressure combustion gas, and a turbine for generating rotational motive power by a gas turbine rotor blade when the combustion gas is expanded, wherein said gas turbine rotor blade is the gas turbine rotor blade according to claim 15.

18. A gas turbine power plant including a generator for generating electric power with the rotational motive power generated by the gas turbine according to claim 17.

* * * * *